US012760232B2

(12) United States Patent
Morozov et al.

(10) Patent No.: US 12,760,232 B2
(45) Date of Patent: Oct. 13, 2026

(54) DRAG REDUCING AGENT FOR WATER-IN-OIL EMULSION

(71) Applicant: IRIS TECH, INC., Houston, TX (US)

(72) Inventors: Vladimir Dmitrievich Morozov, Mamadysh (RU); Aleksandr Aleksandrovich Nikitin, Kazan (RU); Roman Nikolaevich Kostromin, Kazan (RU); Igor Aleksandrovich Malykhin, Moscow (RU)

(73) Assignee: IRIS TECH, INC., Houston, TX (US)

( * ) Notice: Subject to any disclaimer, the term of this patent is extended or adjusted under 35 U.S.C. 154(b) by 124 days.

(21) Appl. No.: 18/507,214

(22) Filed: Nov. 13, 2023

(65) Prior Publication Data

US 2025/0154416 A1 May 15, 2025

(51) Int. Cl.
*C10G 99/00* (2006.01)

(52) U.S. Cl.
CPC ..... *C10G 99/00* (2013.01); *C10G 2300/4075* (2013.01)

(58) Field of Classification Search
CPC ..... C10G 99/00; C10G 2300/4075
USPC ..... 585/4
See application file for complete search history.

(56) References Cited

U.S. PATENT DOCUMENTS

| | | | | |
|---|---|---|---|---|
| 4,693,321 | A | 9/1987 | Royer | |
| 5,027,843 | A * | 7/1991 | Grabois | C09K 8/68 507/225 |
| 6,841,593 | B2 | 1/2005 | Kommareddi et al. | |
| 2005/0049327 | A1 * | 3/2005 | Jovancicevic | C10L 1/2366 523/175 |
| 2008/0064785 | A1 | 3/2008 | Martin et al. | |
| 2022/0306930 | A1 * | 9/2022 | Vittur | C09K 8/604 |

FOREIGN PATENT DOCUMENTS

RU 2743532 C1 2/2021

* cited by examiner

*Primary Examiner* — Prem C Singh
*Assistant Examiner* — Francis C Campanell
(74) *Attorney, Agent, or Firm* — Nadya Reingand

(57) ABSTRACT

A drag reducing agent for a water-in-oil emulsion is provided. The agent comprises a water-soluble powder component and a fat-soluble powder component. The weight ratio of the water-soluble powder component to the fat-soluble powder component in the agent ranges from 1:2 to 1:4. The water-soluble powder component is made of polyacrylamide, and the fat-soluble powder component is made of polyacrylate. By using the powder form of the water-soluble and fat-soluble components, it is possible to mix them into the water-in-oil emulsion, which may significantly reduce the hydrodynamic drag of the water-in-oil emulsion. In a preferred embodiment, the fat-soluble powder component is made of polyacrylate latex. In an optional embodiment, the agent may further comprise an anti-agglomeration agent to prevent the fat-soluble and water-soluble powder components from agglomerating with each other.

5 Claims, 3 Drawing Sheets

DRAG REDUCING AGENT FOR WATER-IN-OIL EMULSION

FIELD OF THE INVENTION

The invention relates to drag reducing agents used in the transportation of water-in-oil emulsions through pipelines. In particular, the invention relates to a drag reducing agent in the form of a solid two-component powder additive.

BACKGROUND OF THE INVENTION

U.S. Pat. No. 4,693,321A (published on Sep. 15, 1987) discloses polymeric flow improvers which are encapsulated to form free-flowing particles consisting essentially of normally noncrystalline hydrocarbon-soluble polymers having a molecular weight above 1×106. Polyalphaolefins are used as said flow improvers, and urea formaldehyde resin is used as an encapsulant. However, such an additive contains a small amount of the active base relative to the total mass of the additive. This additive cannot be effectively used in water-in-oil emulsions, since polyalphaolefins are not water-soluble and do not change its properties.

U.S. Pat. No. 6,841,593B2 (published on Jan. 16, 2003) discloses a particulate compound for modifying a characteristic of a fluid. The particulate compound comprises a core and a shell encapsulating the core. The core comprises a mixture of components selected from the group consisting of polymers formed within the shell and monomers which are polymerized within the shell, with the shell being inert to monomer polymerization. The encapsulated core is cryogenically ground to form the particulate compound, in which the shell acts as an anti-agglomeration agent. In particular, the core comprises the mixture of the following components: alpha-olefins, such as 1-hexene, 1-octene, 1-decene, 1-dodecene, 1-tetradecene, etc.; isobutylene; alkyl acrylates; alkyl methacrylates. The shell is selected from the group of materials consisting of polybutylene, polymethacrylates, waxes, polyethylene glycol (PEG), polypropylene glycol (PPG), alkoxyl terminated PEG, polyethylene oxide (PEO), polypropylene oxide (PPO), stearic acid, polyethylene, wax, and mixtures thereof. However, the additive thus encapsulated is less convenient to use and contains a small amount of the active base relative to the total mass of the additive. Furthermore, this additive cannot be used in water-in-oil emulsions, since it does not contain water-soluble flow improvers.

RU2743532C1 (published on Feb. 19, 2021) discloses a powder agent reducing the hydrodynamic drag of a turbulent flow of liquid hydrocarbons in pipelines. The agent is characterized by a high, not less than 75 wt % content of polyalphaolefin that is prone to reduce the hydrodynamic drag of the turbulent flow of liquid hydrocarbons. The agent additionally comprises a monofunctional heteroatomic organic compound having a number of carbon atoms from 3 to 16 and containing oxygen, nitrogen as a heteroatom, a bifunctional heteroatomic organic compound having a number of carbon atoms from 2 to 16 and containing oxygen, nitrogen, sulfur, phosphorus as a heteroatom, and a separating agent (antiagglomerator). The following ratio of these components in wt % is used:

- a finely dispersed polyalphaolefin powder—from 75 to 90 wt %,
- the separating agent (antiagglomerator)—from 2 to 15 wt %,

- the monofunctional heteroatomic organic compound with the number of carbon atoms from 3 to 16—from 1 to 10 wt %,
- the bifunctional heteroatomic organic compound with the number of carbon atoms from 2 to 16—from 1 to 10 wt %.

However, the additive disclosed in RU2743532C1 cannot be effectively used in water-in-oil emulsions, since polyalphaolefins are not water-soluble and do not change its properties.

US2008/0064785 (published on Mar. 13, 2008) discloses a drag reducing additive having a bi- or multi-modal particle size distribution to improve the dissolution of polymeric drag reducers. According to US2008/0064785, the frictional pressure drop, or drag, of hydrocarbon fluids flowing through pipelines of various lengths is preferentially lowered by dissolving therein polymeric drag reducer suspensions exhibiting bi- or multimodal particle size distributions. The drag reducers having larger particle sizes dissolve more slowly than the drag reducers having smaller particle sizes. By using at least the bi-modal particle size distributions, the drag reduction effect may be distributed more uniformly over the length of the pipeline where smaller sized particles dissolve sooner after injection (upstream in the pipeline), and larger sized particles dissolve later (further along the pipeline). The drag reducer suspensions with the bi- or multimodal particle size distributions may be made by suspension polymerization. Furthermore, the combinations of polyacrylate-based particles and polyalphaolefin-based particles are used in this additive. However, this additive is not a solid (powder) additive made of the mixture of water-soluble and fat-soluble components, which does not make it possible to effectively improve the fluidity of the water-in-oil emulsion.

US20050049327A1 (published on Mar. 3, 2005) discloses a drag reducing agent for a multiphase flow. According to US20050049327A1, a process for using high molecular weight anionic hydrophilic polymers without forming deleterious emulsions to facilitate flow in multiphase pipelines containing both oil and water (e.g., oil/water, oil/water/gas, oil/water/solids, and oil/water/gas/solids). Specific examples of suitable drag reducing polymers include anionic hydrophilic polyacrylamides and polyacrylates having a molecular weight of greater than 1 megadalton. However, only hydrophilic polymers are used in this agent, which cannot be effectively used in a water-in-oil emulsion due to the absence of fat-soluble component that changes the properties of oil. Furthermore, this additive is liquid, which reduces the amount of the active base and does not allow combining fat-soluble and water-soluble polymers. Thus, such an additive can be effective only in an oil-in-water emulsion, since oil prevents the polyacrylamide from dissolving in the water-in-oil emulsion.

SUMMARY OF THE INVENTION

The object of the invention is to provide a drag reducing agent comprising a proper amount of the active base that is effective for reducing the hydrodynamic drag of a water-in-oil emulsion.

The object above is achieved by the features of the independent claims in the appended claims. Further embodiments and examples are apparent from the dependent claims, the detailed description, and the accompanying drawings.

According to a first aspect, a drag reducing agent for a water-in-oil emulsion is provided. The agent comprises a water-soluble powder component and a fat-soluble powder component. The weight ratio of the water-soluble powder component to the fat-soluble powder component in the agent ranges from 1:2 to 1:4. The water-soluble powder component is made of polyacrylamide, and the fat-soluble powder component is made of polyacrylate. By using the powder form of the water-soluble and fat-soluble components, it is possible to mix them into the water-in-oil emulsion, which may significantly reduce the hydrodynamic drag of the water-in-oil emulsion.

In one exemplary embodiment of the first aspect, the fat-soluble powder component is made of polyacrylate latex. In this embodiment, the fat-soluble powder component has a particle size of 25-600 microns and a molecular weight equal to or more than one million g/mol. By using this fat-soluble powder component, it is possible to reduce the hydrodynamic drag of the water-in-oil emulsion more efficiently. More specifically, the higher the molecular weight of the latex-based fat-soluble powder component, the better drag reduction properties it provides. In turn, a too large particle size leads to long dissolution, which negatively affects the rate of reduction of the hydrodynamic drag; a too small particle size negatively affects the upper value of the molecular weight.

In one exemplary embodiment of the first aspect, the agent further comprises an anti-agglomeration agent configured to prevent the fat-soluble powder component and the water-soluble powder component from agglomerating with each other. By avoiding said agglomeration, it is possible to make the agent more efficient in terms of hydrodynamic drag reduction.

According to a second aspect, a method for reducing the hydrodynamic drag of a water-in-oil emulsion by using the drag reducing agent according to the first aspect is provided. The method starts with the steps of preparing the water-soluble and fat-soluble powder components of the drag reducing agent. Then, the method proceeds to the step of stirring the water-soluble powder component and the fat-soluble powder component in a weight ratio ranging from 1:2 to 1:4. Next, the method goes on to the step of calculating an amount of the drag reducing agent to be added to a pipeline through which the water-in-oil emulsion is pumped. Said calculation is performed based on properties of the water-in-oil emulsions (e.g., a water content, an oil composition, an emulsion temperature, requirements for an additive content in oil, etc.). After that, the method proceeds to the step of feeding the calculated amount of the drag reducing agent to the water-in-oil emulsion pumped through the pipeline. By mixing this agent into the water-in-oil emulsion, it is possible to significantly reduce the hydrodynamic drag of the water-in-oil emulsion.

In one exemplary embodiment of the second aspect, the water-in-oil emulsion has a water cut ranging from 15% to 75%. This implies that the method according to the second aspect may be efficiently used for a wide range of water cutes, thereby increasing its range of application.

Other features and advantages of the present disclosure will be apparent upon reading the following detailed description and reviewing the accompanying drawings.

BRIEF DESCRIPTION OF DRAWINGS

The invention is explained below with reference to the accompanying drawings in which.

DETAILED DESCRIPTION OF THE INVENTION

Figure 1A:
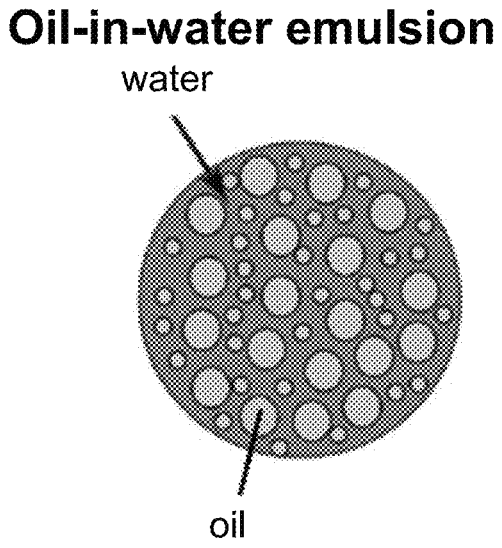
FIGS. 1A and 1B show two types of emulsions: oil-in-water (FIG. 1A) and water-in-oil (FIG. 1B)

This section describes the main embodiment of the invention, which, however, does not limit other possible embodiments explicitly described herein and apparent to those skilled in the art.

The embodiments disclosed herein relate to an agent for reducing the hydrodynamic drag of a flow of liquid hydrocarbons in pipelines. This agent is hereinafter referred to as the drag reducing agent. The drag reducing agent is in the form of a solid two-component powder additive comprising water-soluble and fat-soluble polymer particles which are stirred in a proper weight ratio in accordance with the embodiments disclosed herein.

The agent may be prepared according to the following main procedure.

First, a fat-soluble powder component is prepared. The fat-soluble powder component is based on polyacrylates which are known to have drag reduction properties. For example, polyacrylate latex may be used as the fat-soluble powder component. The particles of the fat-soluble powder component can be formed by polymerizing at least one monomer selected from the group comprising acrylates, methacrylates, including, but not limited to, 2-Ethylhexyl methacrylate, isobutyl methacrylate, butyl methacrylate, acrylic acid, and combinations thereof. If polyacrylate latex is used, the latex particles of the drag reducing agent may be formed by polymerizing 2-Ethylhexyl methacrylate, isobutyl methacrylate, butyl methacrylate, acrylates, including, but not limited to, 2-Ethylhexyl acrylate, isobutyl acrylate, butyl acrylate, typically alcohol esters from C1 to C10 of acrylic acid or methacrylic acid, with a small amount of acrylic acid being also added to prepare a terpolymer. The latex particles of the drag reducing agent have a high molecular weight which refers to a value exceeding one million g/mol in the embodiments disclosed herein. The prepared liquid comprising the latex particles is dried by spray drying. The dried material is an active base powder having a particle size of 25-600 microns.

As a water-soluble component, a commercial high molecular weight polyacridamide powder may be used, such as one of the following: Kemira: Superfloc A-130 or Superfloc C-498, SNF: Flopam AN934 or Flopam FO 4190.

The two powder components are further mixed in a specified weight ratio until smooth using a stirrer, and at least one anti-agglomeration agent may be added, if required.

Embodiment 1

The fat-soluble powder component of the drag reducing agent is prepared as follows.

A 250 ml jacketed three-necked flask is placed on a Heidolph magnetic stirrer, and a circulation thermostat is connected to the flask jacket through silicone hoses.

A fluoroplastic-coated magnetic stirrer is placed into the flask. Then, 69.3 g of distilled water in a measuring glass are added to the flask, whereupon the magnetic drive of the stirrer is switched on, with the stirrer rotation speed being 800 rpm. While stirring, a rubber septum is placed into the neck of the flask, and a 250 mm veterinary needle is inserted through the septum, to which a nitrogen bottle from a reducer with a pressure of 0.01 MPa is connected through a silicone hose.

55 g of 2-Ethylhexyl methacrylate are added to the flask in the process of constant stirring and nitrogen supply. Then, 5 g of sodium lauryl sulfate and 6.4 g of neonol 9-12 (other surfactants, such as synthanol, sulfanol can also be used) are added into the flask. Next, everything is stirred for about 15 minutes until sodium lauryl sulfate dissolves. Then, 0.23 g of monosubstituted potassium phosphate and 0.18 g of disubstituted potassium phosphate are added to the reaction mass. Then, stirring and nitrogen purging are performed for half an hour to remove the residual oxygen in the reaction mass.

After the nitrogen purging, 0.2 g of ammonium persulphate (a source of radicals) is added to the reaction mass.

After adding the source of radicals, the circulation thermostat is switched on for the circulation of a heat-transfer medium in the jacket of the flask. A thermocouple is placed into the reaction mass to measure a reaction temperature. The reaction temperature is maintained at 15±1° C.

After the reaction mass reaches the above-indicated temperature, a prepared solution of 0.1 g of Mohr's salt (serving as an initiating agent) in 40 g of distilled water with 0.01 mol/l of sulfuric acid is added into the flask. The rate of adding the initiating agent solution is about 8 g/h.

The stirring and nitrogen purging are continuously performed during the reaction time.

After the reaction, the prepared latex solution is dried in a laboratory spray dryer at a temperature of 110±5° C., after which 2 g of anti-agglomeration agent—calcium stearate—are added thereto.

Then, 3.4 g of octanol and 3.4 g of hexylene glycol are added to the prepared powder, and everything is stirred until smooth.

The water-soluble powder component of the drag reducing agent is prepared as follows.

As noted earlier, a commercial high molecular weight polyacridamide powder may be used as the water-soluble powder component. For example, it is possible to use one of the following: Kemira: Superfloc A-130 or Superfloc C-498, SNF: Flopam AN934 or Flopam FO 4190.

If required, the particles of the water-soluble powder component and/or the fat-soluble powder component may be grinded to make the particles equal in size. Next, the fat-soluble and water-soluble powder components of the drag reducing agent are stirred in a given weight ratio by any suitable means to prepare the ready-to-use drag reducing agent.

Embodiment 2

The fat-soluble powder component of the drag reducing agent is prepared as follows.

A 250 ml jacketed three-necked flask is placed on a Heidolph magnetic stirrer, and a circulation thermostat is connected to the flask jacket through silicone hoses.

A fluoroplastic-coated magnetic stirrer is placed into the flask. Then, 69.3 g of distilled water in a measuring glass are added to the flask, whereupon the magnetic drive of the stirrer is switched on, with the stirrer rotation speed being 800 rpm. While stirring, a rubber septum is placed into the neck of the flask, and a 250 mm veterinary needle is inserted through the septum, to which a nitrogen bottle from a reducer with a pressure of 0.01 MPa is connected through a silicone hose.

55 g of isobutyl methacrylate are added to the flask in the process of constant stirring and nitrogen supply. Then, 3 g of sodium lauryl sulfate are added into the flask. Next, everything is stirred for about 15 minutes until sodium lauryl sulfate dissolves. Then, 0.23 g of monosubstituted potassium phosphate and 0.18 g of disubstituted potassium phosphate are added to the reaction mass. Then, stirring and nitrogen purging are performed for half an hour to remove the residual oxygen in the reaction mass.

After the nitrogen purging, 0.2 g of ammonium persulphate (a source of radicals) is added to the reaction mass.

After adding the source of radicals, the circulation thermostat is switched on for the circulation of a heat-transfer medium in the jacket of the reaction flask. A thermocouple is placed into the reaction mass to measure a reaction temperature. The reaction temperature is maintained at 15±1° C.

After the reaction mass reaches the above-indicated temperature, a prepared solution of 0.1 g of Mohr's salt (serving as an initiating agent) in 40 g of distilled water with 0.01 mol/l of sulfuric acid is added to the flask. The rate of adding the initiating agent solution is about 8 g/h.

The stirring and nitrogen purging are continuously performed during the reaction time.

After the reaction, the prepared latex solution is dried in a laboratory spray dryer at a temperature of 110±5° C., after which 1.17 g of anti-agglomeration agent—zinc stearate—is added to the dry product.

Then, 0.59 g of propanol and 0.59 g of polypropylene glycol are added to the prepared powder, and everything is stirred until smooth.

The water-soluble powder component of the drag reducing agent is prepared as follows.

As noted earlier, a commercial high molecular weight polyacridamide powder may be used as the water-soluble powder component. For example, it is possible to use one of the following: Kemira: Superfloc A-130 or Superfloc C-498, SNF: Flopam AN934 or Flopam FO 4190.

If required, the particles of the water-soluble powder component and/or the fat-soluble powder component may be grinded to make the particles equal in size. Next, the fat-soluble and water-soluble powder components of the drag reducing agent are stirred in a given weight ratio by any suitable means to prepare the ready-to-use drag reducing agent.

Embodiment 3

In this embodiment, the other version of the fat-soluble powder component is used compared to those from embodiments 1 and 2.

A 250 ml jacketed three-necked flask is placed on a Heidolph magnetic stirrer, and a circulation thermostat is connected to the flask jacket through silicone hoses.

A fluoroplastic-coated magnetic stirrer is placed into the flask. Then, 69.3 g of distilled water in a measuring glass are added to the flask, whereupon the magnetic drive of the stirrer is switched on, with the stirrer rotation speed being 800 rpm. While stirring, a rubber septum is placed into the neck of the flask, and a 250 mm veterinary needle is inserted through the septum, to which a nitrogen bottle from a reducer with a pressure of 0.01 MPa is connected through a silicone hose.

55 g of butyl methacrylate are added to the flask in the process of constant stirring and nitrogen supply. Then, 5 g of sodium lauryl sulfate and 2.7 g of neonol 9-12 are added to the flask. Next, everything is stirred for about 15 minutes until sodium lauryl sulfate dissolves. Then, 0.23 g of monosubstituted potassium phosphate and 0.18 g of disubstituted potassium phosphate are added to the reaction mass. Then, stirring and nitrogen purging are performed for half an hour to remove the residual oxygen in the reaction mass.

After the nitrogen purging, 0.2 g of ammonium persulphate (a source of radicals) is added to the reaction mass.

After adding the source of radicals, the circulation thermostat is switched on for the circulation of a heat-transfer medium in the jacket of the flask. A thermocouple is placed into the reaction mass to measure a reaction temperature. The reaction temperature is maintained at 15±1° C.

After the reaction mass reaches the above-indicated temperature, a prepared solution of 0.1 g of Mohr's salt (initiating agent) in 40 g of distilled water with 0.01 mol/l of sulfuric acid is added to the flask. The rate of adding the initiating agent solution is about 8 g/h.

The stirring and nitrogen purging are continuously performed during the reaction time.

After the reaction, the prepared latex solution is dried in a laboratory spray dryer at a temperature of 110±5° C., after which 5.7 g of anti-agglomeration agent—is zinc stearate—are added to the dry product.

Then, 8.8 g of tridecyl amine and 8.8 g of tripentyl phosphate are added to the prepared powder, and everything is stirred until smooth.

The water-soluble powder component of the drag reducing agent is prepared as follows.

As noted earlier, a commercial high molecular weight polyacridamide powder may be used as the water-soluble component. For example, it is possible to use one of the following: Kemira: Superfloc A-130 or Superfloc C-498, SNF: Flopam AN934 or Flopam FO 4190.

If required, the particles of the water-soluble powder component and/or the fat-soluble powder component are grinded to make the particles equal in size. Next, the fat-soluble and water-soluble powder components of the drag reducing agent are stirred in a given weight ratio by any suitable means to prepare the ready-to-use drag reducing agent.

Embodiment 4

The fat-soluble powder component of the drag reducing agent is prepared as follows.

A 250 ml jacketed three-necked flask is placed on a Heidolph magnetic stirrer, and a circulation thermostat is connected to the flask jacket through silicone hoses.

A fluoroplastic-coated magnetic stirrer is placed into the flask. Then, 69.3 g of distilled water in a measuring glass are added to the flask, whereupon the magnetic drive of the stirrer is switched on, with the stirrer rotation speed being 800 rpm. While stirring, a rubber septum is placed into the neck of the flask, and a 250 mm veterinary needle is inserted through the septum, to which a nitrogen bottle from a reducer with a pressure of 0.01 MPa is connected through a silicone hose.

55 g of 2-Ethylhexyl methacrylate and isobutyl methacrylate in equal proportion are added to the flask in the process of constant stirring and nitrogen supply. Then, 5.4 g of neonol 9-12 are added to the flask. Next, everything is stirred for about 15 minutes until sodium lauryl sulfate dissolves. Then, 0.23 g of monosubstituted potassium phosphate and 0.18 g of disubstituted potassium phosphate are added to the reaction mass. Then, stirring and nitrogen purging are performed for half an hour to remove the residual oxygen in the reaction mass.

After the nitrogen purging, 0.2 g of ammonium persulphate (a source of radicals) is added to the reaction mass.

After adding the source of radicals, the circulation thermostat is switched on for the circulation of a heat-transfer medium in the jacket of the reaction flask. A thermocouple is placed into the reaction mass to measure a reaction temperature. The reaction temperature is maintained at 15±1° C.

After the reaction mass reaches the above-indicated temperature, a prepared solution of 0.1 g of Mohr's salt (initiating agent) in 40 g of distilled water with 0.01 mol/l of sulfuric acid is added to the flask. The rate of adding the initiating agent solution is about 8 g/h.

The stirring and nitrogen purging are continuously performed during the reaction time.

After the reaction, the prepared latex solution is dried in a laboratory spray dryer at a temperature of 110±5° C., after which 12.8 g of anti-agglomeration agent—talcum—are added to the dry product.

Then, 6.1 g of decanol and 3 g of texanol are added to the prepared powder, and everything is stirred until smooth.

The water-soluble powder component of the drag reducing agent is prepared as follows.

As noted earlier, a commercial high molecular weight polyacridamide powder may be used as the water-soluble powder component. For example, it is possible to use one of the following: Kemira: Superfloc A-130 or Superfloc C-498, SNF: Flopam AN934 or Flopam FO 4190.

If required, the particles of the water-soluble powder component and/or the fat-soluble powder component may be grinded to make the particles equal in size. Next, the fat-soluble and water-soluble powder components of the drag reducing agent are stirred in a given weight ratio by any suitable means to prepare the ready-to-use drag reducing agent.

Analysis of Dissolution Dynamics

To perform dissolution dynamics-aimed tests, water-in-oil emulsions with a different amount of reservoir water were prepared. The data of oil under test are given in Table 1 shown below.

TABLE 1

Physical and chemical properties of oil under test

| Parameter name | Value |
|---|---|
| Density at 20° C., kg/m$^3$: | 900-908 |
| Oil freezing point, ° C. | +2 |
| Paraffin wt. % | 5.4-6.7 |
| Kinematic viscosity at 20° C., mm$^2$/s | 121 |
| Mechanical impurities wt. % | 0.0008-0.0100 |

The tests are based on measuring the viscosity of the water-in-oil emulsion at 60° C. (which is an oil transport temperature) over time using a Brookfield viscometer in a temperature-controlled cell. The viscosity growth indicates the dissolution of the drag reducing agent in the water-in-oil emulsion, thereby indicating its effectiveness.

Using a spatula, the drag reducing agent was added to the water-in-oil emulsion. Oil was stirred with the drag reducing agent using a magnetic stirrer. The data obtained are given in FIGS. 2-5 and in Tables 2-7 below.

In Tables 2-8, the total mass of all versions of the drag reducing agent is the same, that is, for example, the mass of the drag reducing agent based on pure polyacrylamide (PAM) is equal to the mass of the drag reducing agent prepared by stirring a PAM-based additive and an acrylate-based additive (ADRA).

FIGS. 1A and Table 2 show a version of the oil-in-water emulsion, in which oil droplets are in water at 25% water cut of the emulsion. The water cut of the oil-in-water emulsion below 25% is not considered, since practically, there are no oil-in-water emulsions with such a low water cut.

TABLE 2

| Oil-in-water emulsion, 25% water cut | | | | | | | | |
|---|---|---|---|---|---|---|---|---|
| | (Dry) PAM | (Dry) ADRA | PAM:ADRA (4:1) | PAM:ADRA (3:1) | PAM:ADRA (2:1) | PAM:ADRA (1:1) | PAM:ADRA (1:2) | PAM:ADRA (1:3) |
| | Oil temperature +60, ° C. | | | | | | | |
| Time, min | viscosity mPas | viscosity mPas | viscosity mPas | viscosity mPas | viscosity mPas | viscosity mPas | viscosity mPas | viscosity mPas |
| 0 | 44.0 | 44.3 | 44.2 | 44.1 | 44.5 | 44.0 | 44.4 | 44.3 |
| 15 | 219 | 45 | 293 | 338 | 274 | 248 | 157 | 67 |
| 30 | 363 | 45 | 420 | 470 | 433 | 385 | 224 | 92 |
| 45 | 507 | 46 | 551 | 596 | 579 | 533 | 260 | 102 |
| 60 | 546 | 47 | 607 | 633 | 620 | 572 | 279 | 125 |
| 90 | 603 | 48 | 668 | 708 | 681 | 605 | 308 | 142 |

Table 2 shows that, in case of the oil-in-water emulsion with 25% water cut, the additive containing only the PAM component shows growth of the viscosity, and the drag reducing agent containing only the ADRA practically does not change the viscosity of the oil-in-water emulsion. This is probably due to the fact that the pure ADRA is not water-soluble, does not change its properties, for which reason changes in the properties of the oil droplets in water do not affect the total viscosity of the oil-in-water emulsion.

When adding the ADRA to PAM in a weight ratio of 3:1, more than 17% viscosity growth is observed in 90 minutes, which indicates the combination due to the use of the ADRA and PAM in the weight ratio of 3:1. This ratio provides the combination due to the maximal dissolution rate of the acrylate and polyacrylamide additives in the emulsion. Thus, in case of increase in the content of the acrylate additive up to 50%, its dissolution rate decreases due to the overdosing of the acrylate additive. The additional reduction of the PAM:ADRA ratio results in the decrease in the dissolution rate of the mixture in the emulsion due to the decrease in the content of polyacrylamide. The ratio 4:1 shows the decrease in the dissolution rate of the mixture due to the maximal dissolution rate of PAM in reservoir water. The ratio 2:1 shows the decrease in the dissolution rate due to the PAM deficiency.

If the PAM-to-ADRA ratio of is 1:1, 1:2, 1:3, no viscosity growth observed, lower values in the right most columns of Table 2 are associated with the decrease of the PAM content in the additive.

Figure 1B:
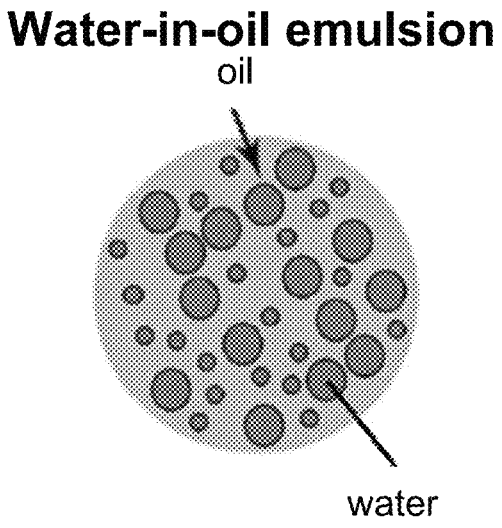

FIG. 1B and Table 3 show a version of the water-in-oil emulsion, in which water droplets are in oil at 25% water cut of the emulsion. Usually, such an emulsion is formed in oil pipelines, so this version is most favorable in terms of reducing the cost of transporting the emulsion.

TABLE 3

| Water-in-oil emulsion, 25% water cut | | | | |
|---|---|---|---|---|
| | (Dry) PAM | (Dry) ADRA | PAM:ADRA (3:1) | PAM:ADRA (1:1) |
| | Oil temperature +60, ° C. | | | |
| Time, min | viscosity, mPas | viscosity, mPas | viscosity, mPas | viscosity, mPas |
| 0 | 292.7 | 294.0 | 293.6 | 292.2 |
| 15 | 293 | 321 | 312 | 331 |
| 30 | 293 | 335 | 317 | 348 |
| 45 | 293 | 354 | 320 | 359 |
| 60 | 293 | 359 | 327 | 366 |

TABLE 3-continued

| Water-in-oil emulsion, 25% water cut | | | | |
|---|---|---|---|---|
| 90 | 293 | 365 | 336 | 378 |
| | PAM:ADRA (1:2) | PAM:ADRA (1:3) | PAM:ADRA (1:4) | PAM:ADRA (1:5) |
| | Oil temperature +60, ° C. | | | |
| Time, min | viscosity, mPas | viscosity, mPas | viscosity, mPas | viscosity, mPas |
| 0 | 293.1 | 291.9 | 292.1 | 292.6 |
| 15 | 384 | 356 | 339 | 324 |
| 30 | 397 | 367 | 351 | 337 |
| 45 | 403 | 378 | 363 | 355 |
| 60 | 416 | 394 | 371 | 360 |
| 90 | 432 | 402 | 385 | 369 |

Table 3 shows that, in case of the water-in-oil emulsion with 25% water cut, the drag reducing agent containing only the ADRA component shows the viscosity growth, and the drag reducing agent containing only PAM does not change the viscosity of the emulsion. This is probably due to the fact that pure PAM is not oil-soluble, does not change its properties, for which reason changes in the properties of the water droplets in oil do not affect the total viscosity of the water-in-oil emulsion.

When adding PAM to the ADRA in a weight ratio from 1:3 to 1:1, from 3.5% viscosity growth in the weight ratio of 1:1 to more than 18% viscosity growth in the weight ratio of 1:2 is observed in 90 minutes, in which cases the viscosity almost reaches the values of the pure ADRA in a weight ratio of 1:5, which indicates the combination due to the use of PAM and the ADRA in a weight ratio from 1:1 to 1:4. The ratio of PAM-to-ADRA ratio of 1:2 provides the combination due to the maximal dissolution rate of the acrylate and polyacrylamide additives. Thus, the increase in the content of the acrylate additive up to the ratio of 1:4 results in the maximal dissolution rate of the acrylate additive. The additional increase in the content of the acrylate additive results in the decrease in the dissolution rate of the mixture in the emulsion. When the content of the acrylate additive is reduced to a weight ratio of 1:1, the prepared mixture is not sufficient to provide maximal dissolution rate, which indicates the acrylate additive deficiency.

If the ratio of PAM-to-ADRA ratio is 3:1, no viscosity growth observed, loss in values is associated with the decrease of the ADRA content in the additive.

Figure 2:
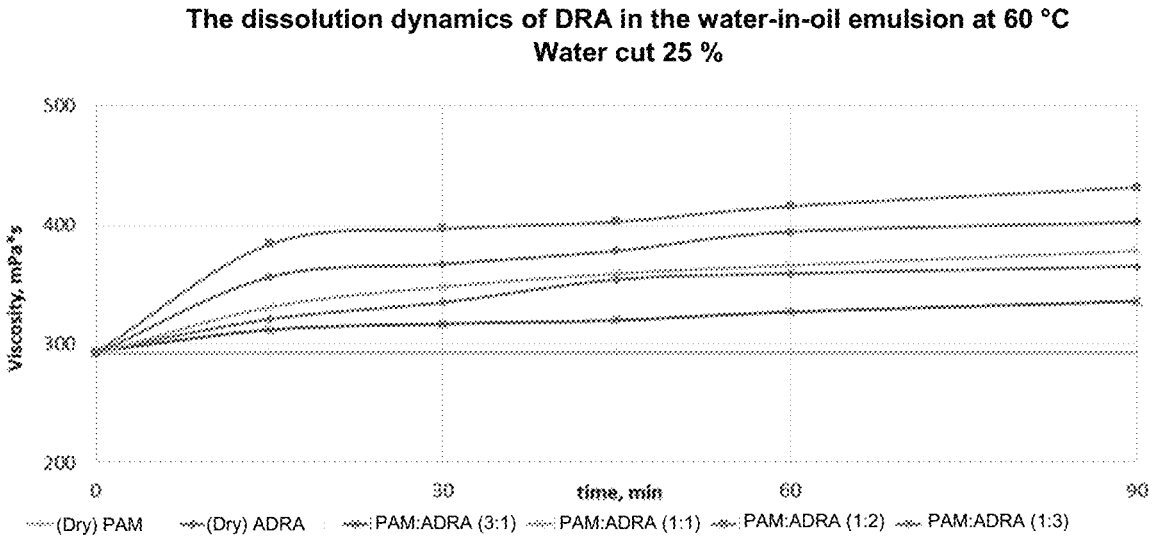
FIG. 2 shows a dissolution diagram of a drag reducing agent according to the invention in the water-in-oil emulsion at +60° C. and 25% water cut.

At least the part of the data from Table 3 is visualized in FIG. 2 for illustrative purposes.

Table 4 shows a version of the oil-in-water emulsion, in which oil droplets are in water at 50% water cut of the emulsion.

TABLE 4

| Oil-in-water emulsion, 50% water cut | | | | | | | | |
|---|---|---|---|---|---|---|---|---|
| | (Dry) PAM | (Dry) ADRA | PAM:ADRA (4:1) | PAM:ADRA (3:1) | PAM:ADRA (2:1) | PAM:ADRA (1:1) | PAM:ADRA (1:2) | PAM:ADRA (1:3) |
| | Oil temperature +60, ° C. | | | | | | | |
| Time, min | viscosity mPas | viscosity mPas | viscosity mPas | viscosity mPas | viscosity mPas | viscosity mPas | viscosity mPas | viscosity mPas |
| 0 | 69.0 | 70.3 | 68.2 | 70.0 | 71.5 | 68.7 | 70.4 | 69.3 |
| 15 | 244 | 70 | 309 | 353 | 297 | 267 | 177 | 84 |
| 30 | 388 | 70 | 442 | 493 | 454 | 408 | 246 | 99 |
| 45 | 532 | 71 | 576 | 614 | 592 | 556 | 270 | 125 |
| 60 | 573 | 71 | 620 | 659 | 645 | 599 | 292 | 131 |
| 90 | 622 | 71 | 687 | 721 | 699 | 628 | 325 | 149 |

Table 4 shows that, in case of the oil-in-water emulsion with 50% water cut, the drag reducing agent containing only the PAM component shows the viscosity growth, and the drag reducing agent containing only the ADRA practically does not change the viscosity of the oil-in-water emulsion. This is probably due to the fact that the pure ADRA is not water-soluble, does not change its properties, for which reason changes in the properties of the oil droplets in water do not affect the total viscosity of the oil-in-water emulsion.

When adding the ADRA to PAM in a weight ratio of 3:1, more than 15% viscosity growth is observed in 90 minutes, which indicates the combination due to the use of the ADRA and PAM in the weight ratio of 3:1. This ratio provides the combination due to the maximal dissolution rate of the acrylate and polyacrylamide additives in the emulsion. Thus, in case of increase in the content of the acrylate additive up to 50%, the dissolution rate decreases due to the overdosing of the acrylate additive. The additional reduction of the PAM-to-ADRA ratio results in the decrease in the dissolution rate of the mixture in the emulsion due to the decrease in the content of polyacrylamide. The ratio of 4:1 shows the decrease in the dissolution rate of the mixture due to the maximal dissolution rate of PAM in reservoir water. The ratio of 2:1 shows the decrease in the dissolution rate due to the PAM deficiency.

If the ratio of PAM-to-ADRA ratio is 1:1, 1:2, or 1:3, no viscosity growth observed, lower values in the right most columns of Table 4 are associated with the decrease of the PAM content in the additive.

Table 5 shows a version of the water-in-oil emulsion, in which water droplets are in oil at 50% water cut of the emulsion.

TABLE 5

| Water-in-oil emulsion, 50% water cut | | | | |
|---|---|---|---|---|
| | (Dry) PAM | (Dry) ADRA | PAM:ADRA (3:1) | PAM:ADRA (1:1) |
| | Oil temperature +60, ° C. | | | |
| Time, min | viscosity, mPas | viscosity, mPas | viscosity, mPas | viscosity, mPas |
| 0 | 452.5 | 453.0 | 454.2 | 453.4 |
| 15 | 453 | 481 | 470 | 494 |
| 30 | 453 | 493 | 475 | 506 |
| 45 | 453 | 504 | 477 | 517 |
| 60 | 453 | 509 | 482 | 527 |
| 90 | 453 | 515 | 484 | 535 |
| | PAM:ADRA (1:2) | PAM:ADRA (1:3) | PAM:ADRA (1:4) | PAM:ADRA (1:5) |
| | Oil temperature +60, ° C. | | | |

TABLE 5-continued

| Water-in-oil emulsion, 50% water cut | | | | |
|---|---|---|---|---|
| Time, min | viscosity, mPas | viscosity, mPas | viscosity, mPas | viscosity, mPas |
| 0 | 452.7 | 453.3 | 453.5 | 453.7 |
| 15 | 547 | 511 | 497 | 482 |
| 30 | 572 | 534 | 512 | 492 |
| 45 | 589 | 547 | 524 | 506 |
| 60 | 592 | 562 | 531 | 511 |
| 90 | 609 | 571 | 539 | 516 |

Table 5 shows that, in case of the water-in-oil emulsion with 50% water cut, the drag reducing agent containing only the ADRA component shows the viscosity growth, and the drag reducing agent containing only PAM does not change the viscosity of the emulsion. This is probably due to the fact that pure PAM is not oil-soluble, does not change its properties, for which reason changes in the properties of the water droplets in oil do not affect the total viscosity of the water-in-oil emulsion.

When adding PAM to the ADRA in a weight ratio from 1:4 to 1:1, from up to 4% viscosity growth in the weight ratio of 1:1 to more than 18% viscosity growth in the weight ratio of 1:2 is observed in 90 minutes, in which cases the viscosity almost reaches 5% in the weight ratio of 1:4, which indicates the combination due to the use of PAM and the ADRA in the weight ratio from 1:1 to 1:4. The ratio of PAM-to-ADRA ratio of 1:2 provides the combination due to the maximal dissolution rate of the acrylate and polyacrylamide additives. Thus, the increase in the content of the acrylate additive up to the weight ratio of 1:4 results in the maximal dissolution rate of the acrylate additive. The additional increase in the content of the acrylate additive results in the decrease in the dissolution rate of the mixture in the emulsion. When the content of the acrylate additive is reduced to the weight ratio of 1:1, the prepared mixture is not sufficient to provide maximal dissolution rate, which indicates the acrylate additive deficiency.

If the ratio of PAM-to-ADRA ratio is 3:1, no viscosity growth observed, loss in values is associated with the decrease of the ADRA content in the additive.

Figure 3:
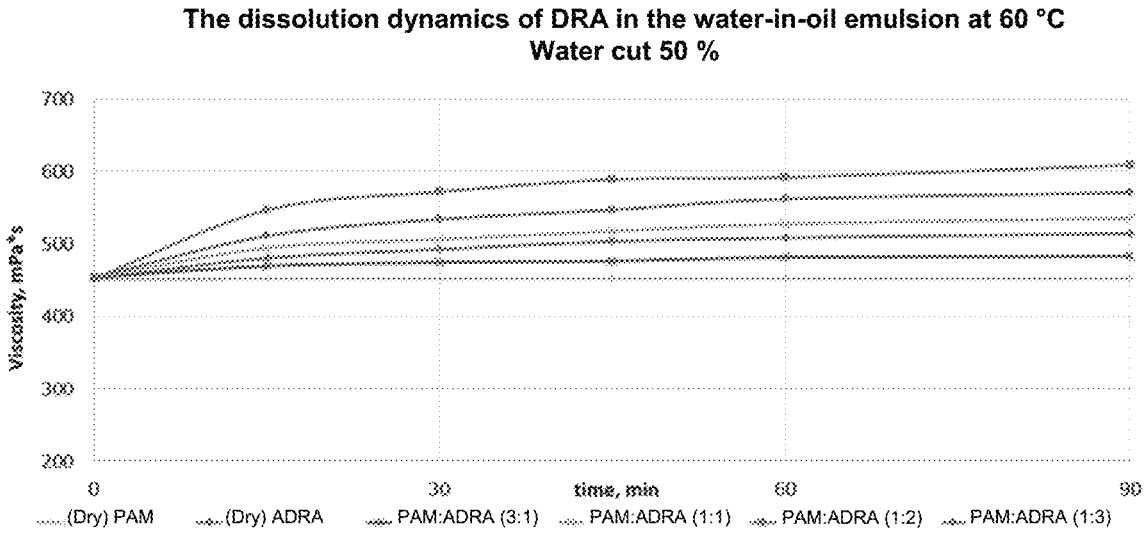
FIG. 3 shows a dissolution diagram of the drag reducing agent according to the invention in the water-in-oil emulsion at +60° C. and 50% water cut.

At least the part of the data from Table 5 is visualized in FIG. 3 for illustrative purposes.

Table 6 shows a version of the oil-in-water emulsion, in which oil droplets are in water at 75% water cut of the emulsion.

TABLE 6

| Oil-in-water emulsion, 75% water cut | | | | | | | | |
|---|---|---|---|---|---|---|---|---|
| | (Dry) PAM | (Dry) ADRA | PAM:ADRA (4:1) | PAM:ADRA (3:1) | PAM:ADRA (2:1) | PAM:ADRA (1:1) | PAM:ADRA (1:2) | PAM:ADRA (1:3) |
| | Oil temperature +60, ° C. | | | | | | | |
| Time, min | viscosity mPas | viscosity mPas | viscosity mPas | viscosity mPas | viscosity mPas | viscosity mPas | viscosity mPas | viscosity mPas |
| 0 | 101.0 | 102.0 | 103.1 | 103.4 | 101.6 | 102.8 | 102.2 | 103.1 |
| 15 | 361 | 102 | 383 | 439 | 392 | 336 | 242 | 116 |
| 30 | 486 | 103 | 529 | 606 | 548 | 462 | 349 | 146 |
| 45 | 608 | 103 | 644 | 741 | 690 | 583 | 382 | 161 |
| 60 | 723 | 105 | 758 | 850 | 784 | 698 | 435 | 175 |
| 90 | 877 | 106 | 912 | 1004 | 947 | 812 | 489 | 188 |

Table 6 shows that, in case of the oil-in-water emulsion with 75% water cut, the drag reducing agent containing only the PAM component shows the viscosity growth, and the drag reducing agent containing only the ADRA practically does not change the viscosity of the oil-in-water emulsion. This is probably due to the fact that the pure ADRA is not water-soluble, does not change its properties, for which reason changes in the properties of the oil droplets in water do not affect the total viscosity of the oil-in-water emulsion.

When adding the ADRA to PAM in a weight ratio of 3:1, up to 15% viscosity growth is observed in 90 minutes, which indicates the combination due to the use of the ADRA and PAM in the weight ratio of 3:1. This ratio provides the combination due to the maximal dissolution rate of the acrylate and polyacrylamide additives in the emulsion. Thus, in case of increase in the content of the acrylate additive up to 50%, the dissolution rate decreases due to the overdosing of the acrylate additive. The additional reduction of the PAM-to-ADRA weight ratio results in the decrease in the dissolution rate of the mixture in the emulsion due to the decrease in the content of polyacrylamide. The weight ratio of 4:1 shows the decrease in the dissolution rate of the mixture due to the maximal dissolution rate of the PAM in reservoir water. The weight ratio of 2:1 shows the decrease in the dissolution rate due to the PAM deficiency.

If the ratio of PAM-to-ADRA weight ratio is 1:1, 1:2, or 1:3, no viscosity growth observed, lower values in the right most columns of Table 6 are associated with the decrease of the PAM content in the drag reducing agent.

Table 7 shows a version of the water-in-oil emulsion, in which water droplets are in oil at 75% water cut of the emulsion.

TABLE 7

| Water-in-oil emulsion, 75% water cut | | | | |
|---|---|---|---|---|
| | (Dry) PAM | (Dry) ADRA | PAM:ADRA (3:1) | PAM:ADRA (1:1) |
| | Oil temperature +60, ° C. | | | |
| Time, min | viscosity, mPas | viscosity, mPas | viscosity, mPas | viscosity, mPas |
| 0 | 617.0 | 616.2 | 616.8 | 615.9 |
| 15 | 618 | 632 | 620 | 631 |
| 30 | 618 | 644 | 626 | 657 |
| 45 | 618 | 652 | 633 | 672 |
| 60 | 618 | 661 | 639 | 684 |
| 90 | 618 | 675 | 644 | 707 |

TABLE 7-continued

| Water-in-oil emulsion, 75% water cut | | | | |
|---|---|---|---|---|
| | PAM:ADRA (1:2) | PAM:ADRA (1:3) | PAM:ADRA (1:4) | PAM:ADRA (1:5) |
| | Oil temperature +60, ° C. | | | |
| Time, min | viscosity, mPas | viscosity, mPas | viscosity, mPas | viscosity, mPas |
| 0 | 617.1 | 616.4 | 616.9 | 616.2 |
| 15 | 665 | 651 | 643 | 631 |
| 30 | 699 | 680 | 652 | 645 |
| 45 | 712 | 696 | 668 | 652 |
| 60 | 729 | 701 | 674 | 662 |
| 90 | 738 | 714 | 683 | 676 |

Table 7 shows that, in case of the water-in-oil emulsion with 50% water cut, the drag reducing agent containing only the ADRA component shows the viscosity growth, and the drag reducing agent containing only PAM does not change the viscosity of the emulsion. This is probably due to the fact that pure PAM is not oil-soluble, does not change its properties, for which reason changes in the properties of the water droplets in oil do not affect the total viscosity of the water-in-oil emulsion.

When adding PAM to the ADRA in a weight ratio from 1:4 to 1:1, from up to 5% viscosity growth in the weight ratio of 1:1 to more than 9% viscosity growth in the weight ratio of 1:2 is observed in 90 minutes, in which cases the viscosity almost reaches 1% in the weight ratio of 1:4, which indicates the combination due to the use of PAM and the ADRA in the weight ratio from 1:1 to 1:4. The ratio of PAM-to-ADRA weight ratio of 1:2 provides the combination due to the maximal dissolution rate of the acrylate and polyacrylamide additives. Thus, the increase in the content of the acrylate additive up to the weight ratio of 1:4 results in the maximal dissolution rate of the acrylate additive. The additional increase in the content of the acrylate additive results in the decrease in the dissolution rate of the mixture in the emulsion. When the content of the acrylate additive is reduced to the weight ratio of 1:1, the prepared mixture is not sufficient to provide maximal dissolution rate, which indicates the acrylate additive deficiency.

If the ratio of PAM-to-ADRA weight ratio is 3:1, no viscosity growth observed, loss in values is associated with the decrease of the ADRA content in the additive.

Figure 4:
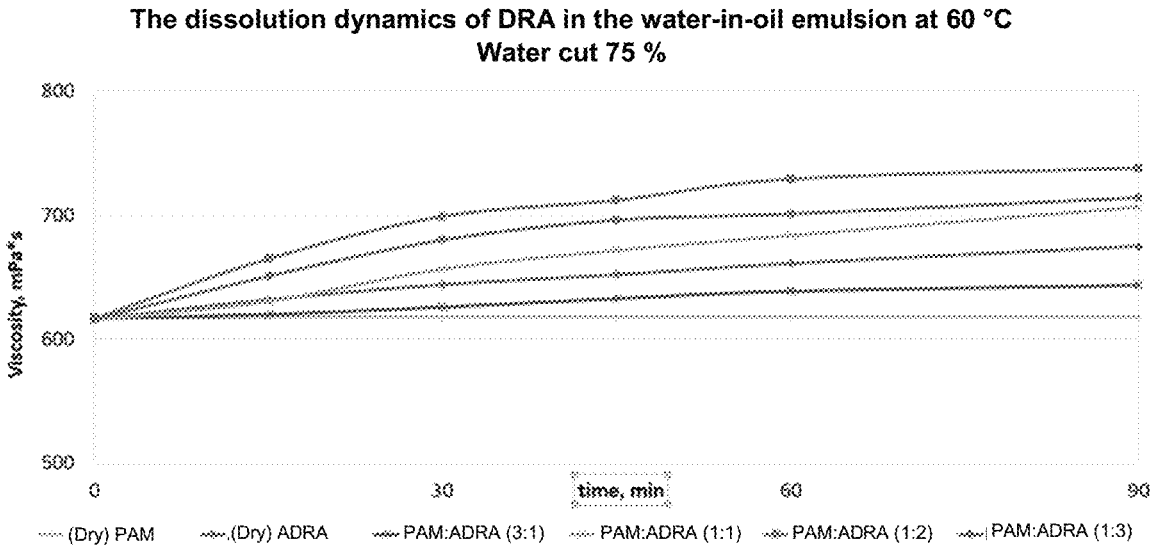
FIG. 4 shows a dissolution diagram of the drag reducing agent according to the invention in the water-in-oil emulsion at +60° C. and 75% water cut.

At least the part of the data from Table 7 is visualized in FIG. 4 for illustrative purposes.

As follows from the above data, it may be concluded that the drag reducing agent according to the invention provides the fast and effective reduction of the hydrodynamic drag of a turbulent flow of water-in-oil emulsions in pipelines and, as a result, provides ramp-up, and reduction in expenses for transporting a hydrocarbon liquid.

The lower limit of the water cut range in which the drag reducing agent shows its efficiency, was analyzed additionally. Table 8 below shows the viscosity of the drag reducing agent in the water-in-oil emulsion at 15% water cut.

TABLE 8

| Water-in-oil emulsion, 15% water cut | | | | | | |
|---|---|---|---|---|---|---|
| | (Dry) PAM | (Dry) ADRA | PAM:ADRA (3:1) | PAM:ADRA (1:1) | PAM:ADRA (1:2) | PAM:ADRA (1:3) |
| | Oil temperature +60, ° C. | | | | | |
| Time, min | viscosity, mPas | viscosity, mPas | viscosity, mPas | viscosity, mPas | viscosity, mPas | viscosity, mPas |
| 0 | 104.3 | 103.8 | 104.1 | 104.2 | 104.0 | 104.1 |
| 15 | 104 | 122 | 109 | 112 | 124 | 123 |
| 30 | 104 | 157 | 115 | 133 | 158 | 157 |
| 45 | 104 | 164 | 122 | 136 | 162 | 164 |
| 60 | 104 | 176 | 129 | 141 | 177 | 175 |
| 90 | 104 | 188 | 134 | 143 | 187 | 188 |

Table 8 shows that at a low water cut the mixture of the two water-soluble and fat-soluble powder components is less effective than the pure ADRA.

As a result, it is preferable to use the drag reducing agent according to the invention in the water cut range from 15 to 75%.

Figure 5:
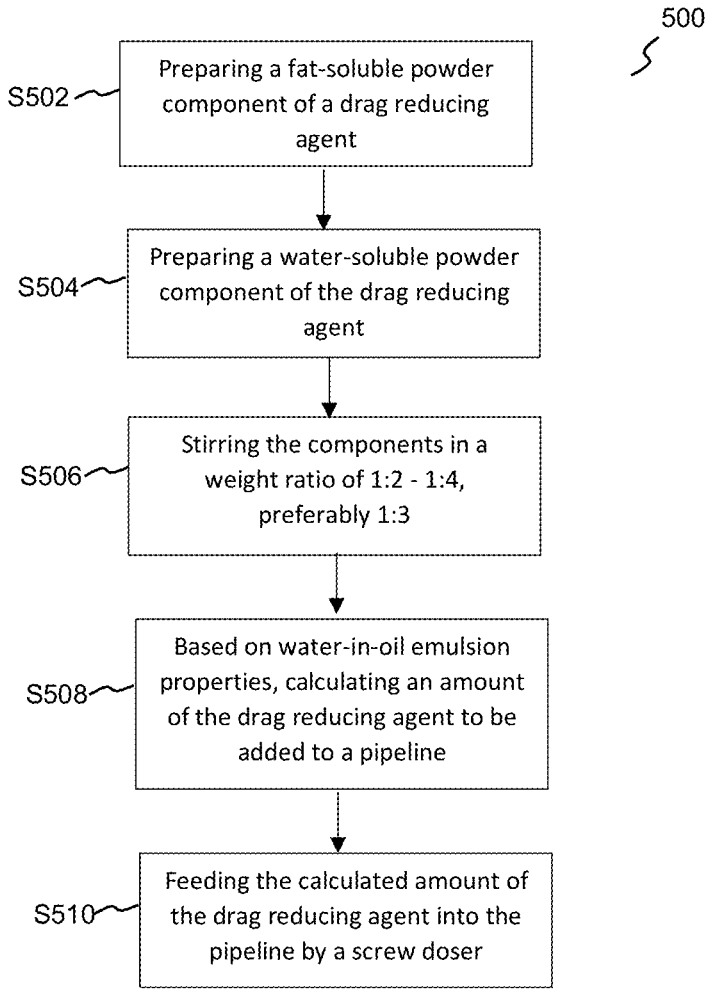
FIG. 5 shows a flowchart of a method for reducing the hydrodynamic drag of the water-in-oil emulsion according to the invention.

FIG. 5 shows a flowchart of a method 500 for reducing the hydrodynamic drag of the water-in-oil emulsion according to the invention. As shown in FIG. 5, the method 500 includes steps S502-S510. In the steps S502 and S504, the fat-soluble and water-soluble powder components of the drag reducing agent are prepared, for example, in accordance with any of embodiments 1-4 discussed above. In the step S506, the components are stirred in a weight ratio of ranging from 1:2 to 1:4, preferably 1:3. In the next step S508, an amount of the drag reducing agent is calculated, which needs to be added to a pipeline through which the water-in-oil emulsion is pumped. The step S508 may be performed based on properties of the water-in-oil emulsion, such as a water content, an oil composition, an emulsion temperature, requirements for an additive content in oil, etc. After that, in the step S510, the calculated amount of the drag reducing agent is added to the pipeline by any suitable means, for example, a screw doser.

The invention is not limited to the embodiments described herein. Other embodiments of the invention staying within the essence and scope of the invention will be apparent to those skilled in the art based on the information set forth herein.

In the appended claims, the word "comprise" and its derivates does not exclude other elements or operations, and the indefinite article "a" or "an" does not exclude a plurality. Furthermore, the steps and/or stages of the method 500 can be performed in an order other than the one discussed above and shown in FIG. 5. For example, the step S504 may be performed before the step S502.

Although exemplary embodiments have been described in detail and shown in the accompanying drawings, it should be understood that such embodiments are illustrative only and are not used to limit the invention and that the invention should not be limited to the specific configurations and structures shown and described, as other various modifications may be apparent to the persons skilled in the relevant field.

The features mentioned in various dependent claims, as well as the implementations disclosed in various parts of the description, can be combined to achieve the advantageous effect, even if the possibility of such a combination is not disclosed explicitly.

The invention claimed is:

1. A drag reducing agent for a water-in-oil emulsion, comprising:

a water-soluble powder component in a dry powder form;

a fat-soluble powder component in a dry powder form;

wherein a weight ratio of the water-soluble powder component to the fat-soluble powder component in the drag reducing agent ranges from 1:2 to 1:4, and wherein the water-soluble powder component is made of polyacrylamide, and the fat-soluble powder component is made of a fat-soluble polyacrylate, the fat-soluble polyacrylate comprising pendant alkyl ester groups having from 1 to 10 carbon atoms in the alkyl moiety and carboxylic acid groups derived from acrylic acid or methacrylic acid, wherein said water-in-oil emulsion flowing through a pipeline.

2. The agent of claim 1, wherein the fat-soluble powder component is made of polyacrylate latex, and wherein the fat-soluble powder component has a particle size of 25-600 microns and a molecular weight equal to or more than one million g/mol.

3. The agent of claim 1, further comprising an anti-agglomeration agent configured to prevent the fat-soluble powder component and the water-soluble powder component from agglomerating with each other.

4. A method for reducing the hydrodynamic drag of a water-in-oil emulsion by using the drag reducing agent according to claim 1, comprising:

preparing the water-soluble powder component of the drag reducing agent;

preparing the fat-soluble powder component of the drag reducing agent;

stirring the water-soluble powder component and the fat-soluble powder component in a weight ratio raging from 1:2 to 1:4;

based on properties of the water-in-oil emulsion, calculating an amount of the drag reducing agent to be added to a pipeline through which the water-in-oil emulsion is pumped; and feeding the calculated amount of the drag reducing agent to the water-in-oil emulsion pumped through the pipeline.

5. The method of claim 4, wherein the water-in-oil emulsion has a water cut ranging from 15 vol % to 75 vol %.

* * * * *